United States Patent [19]

Dutra

[11] Patent Number: 5,042,178

[45] Date of Patent: Aug. 27, 1991

[54] APPARATUS AND PROCESS FOR SOLID DREDGE MATERIAL DISPOSAL

[76] Inventor: Bill T. Dutra, 2884 Woodbridge Rd., Acampo, Calif. 95220

[21] Appl. No.: 509,105

[22] Filed: Apr. 13, 1990

[51] Int. Cl.[5] ..... B63B 25/02; E02F 3/34

[52] U.S. Cl. ..... 37/71; 37/54; 37/195; 405/128; 406/38; 406/197

[58] Field of Search ..... 405/258, 266, 267; 406/197, 96, 33, 38, 195; 37/58, 63, 70, 71, 78, 79, 195, 55; 114/26, 71, 151; 414/142.6, 142.7, 138.1, 140.3, 140.4, 140.9, 142.2, 143.2

[56] References Cited

U.S. PATENT DOCUMENTS

| | | | |
|---|---|---|---|
| 1,055,456 | 3/1913 | Feicks . | |
| 1,690,380 | 11/1928 | Smith | 406/38 |
| 1,750,095 | 3/1930 | Ewig | 406/38 |
| 2,950,724 | 8/1960 | Roederer . | |
| 3,394,809 | 7/1968 | Hunter . | |
| 3,610,414 | 10/1971 | Zumalt . | |
| 3,630,400 | 12/1971 | De Koning | 406/197 X |
| 3,820,258 | 6/1974 | Fahrner | 37/195 X |
| 3,881,530 | 5/1975 | Faldi | 114/27 X |
| 3,975,842 | 8/1976 | Andreae | 37/195 X |
| 4,017,032 | 4/1977 | Dyas . | |
| 4,074,867 | 2/1978 | Jacob . | |
| 4,418,484 | 12/1983 | Wolters et al. | 37/195 X |
| 4,437,982 | 3/1984 | Wasson . | |
| 4,501,446 | 2/1985 | Glaser et al. | 37/195 X |
| 4,692,240 | 9/1987 | Arbuthnot et al. . | |
| 4,759,664 | 7/1988 | Deal . | |

FOREIGN PATENT DOCUMENTS

| | | | |
|---|---|---|---|
| 0190076 | 10/1984 | Japan | 114/27 |

*Primary Examiner*—Dennis L. Taylor
*Attorney, Agent, or Firm*—Townsend and Townsend

[57] ABSTRACT

An apparatus and process for solid dredge material disposal is disclosed for changing the solid materials into a dense slurry for more advantageous dispersal at an aquatic disposal site. The apparatus includes a hopper discharging to a large high volume, low head marine pump supplied with water and power by umbilical attachment to an excavating dredge. The hopper is preferably placed aboard a bottom dump barge for receiving and loading the processed dredge materials from a clam shell dredge. In operation, the dredge excavates solid dredge materials and discharges the materials onto the hopper placed on the barge. The hopper has a grate through which the dredged material falls to affect initial screening of dredged debris as well as breakup of the solids. A matrix of water jets impacts the debris falling from the grate where after the dredged material is passed through a pump in intermittent batches creating a slurry. The slurry is then discharged into the barge, preferably an open bottom dump barge movable by tug from the site of the marine excavation to the disposal site. At the disposal site, the dredged material is discharged from the barge and slurry falls rapidly to the bottom with minimum silt plume confining silt damage to marine life to the immediate vicinity of the disposal site. At the same time there is deposited in the water of the disposal site the slurry which can thereafter be subjected to estuine dispersal by tidal and river currents in a natural manner to avoid filling of the disposal site.

18 Claims, 6 Drawing Sheets

APPARATUS AND PROCESS FOR SOLID DREDGE MATERIAL DISPOSAL

BACKGROUND OF THE INVENTION

This invention relates to dredging. More particularly, an apparatus and process is disclosed for creating a slurry from dredged material solids for dispersal at a disposal site.

STATEMENT OF THE PROBLEM

The marine excavation industry has been subjected to increasing environmental scrutiny. Old techniques no longer are appropriate for disposal and dispersal of dredged materials. A review of these old dredging techniques and their short comings can be instructive.

Hydraulic dredges are known. Such hydraulic dredges have a bottom operated suction, typically with a rotating cutter head. The bottom operated suction discharges to the inlet of a high volume, low head pump driven by a constant power input drive. Dredged materials are typically discharged onto an attending barge or alternately into compartments within the dredge itself, which dredge then acts as the transporting vessel to the disposal site. Such bottom operated suction dredges have many disadvantages.

The most common disadvantage of the hydraulic dredge is production of dredged materials in a slurry having extreme low solids content. It is not uncommon for such dredged materials to have slurry with solids contents as low as 15%. This extreme low solids content requires that the high volume, low silt content dredged materials be transported to a disposal site in many discrete trips. The required number of such discrete trips often renders completely uneconomical the use of hydraulic dredging.

Further, the suction intake of hydraulic dredges clog or foul. In the case of a hydraulic dredge having the rotating cutter head, clogging of the cutter head can be a routine occurrence.

Efforts to consolidate the low solid content slurry have not been successful. It has been common in the past to "overflow" the receiving barge at the dredge site. The overflow has been largely of silt entraining water with the slurry on the barge undergoing natural gravitational classification into a denser slurry.

Unfortunately, this consolidation process generates at the excavation site large quantities of silt. This silt creates a so-called "plume" which damages marine life adjacent to the excavation site. As a consequence, many recently issued permits calling for dredging require that the practice of consolidation with overflow be omitted.

Further, discharge of such low solid content slurry at the disposal site creates a similar problem. Specifically, the slurry from a hydraulic dredge has a specific gravity that is close to that of the water of the marine environment into which the discharge occurs. As a result, an intermixture of the water at the disposal site and the dumped dredged materials slurry occurs. There results a large silt plume. This plume—which—is typically aggravated by the propeller wash of the attending propelling vessel—propagates from the disposal site over a large area. Damage to the marine environment ensues with ambient marine life being destroyed or damaged co-extensive with the created large plume.

To further complicate hydraulic dredging, there are many bottom materials that do not lend themselves to economical bottom dredging. Simply stated, such materials typically consolidate to a dense solid mass where the suction of the marine dredge has grave difficulty in effecting material removal. In such circumstances, the eventual removal of this material can be prohibitively expensive.

Conventional clam shell dredging (positive displacement dredging) has encountered its own problems. Specifically, a conventional clam shell dredge typically generates solid dredged materials. These solid dredged materials have the property to mound; a technical term describing this property is known as slump—a measurement of the slope of the naturally occurring mound when the materials are deposited on dry land.

Difficulty with the solid dredged materials is first encountered when the materials are loaded onto a receiving barge. It is required that the receiving and transporting vessel be loaded with the requirements of marine stability in mind. As a result, attention of the dredge operator (or leverman) must be devoted to spreading the solids on the barge in a even manner so as not to adversely effect stability of the receiving vessel at any stage of the loading.

The gravest difficulty with solid dredge materials is encountered at the disposal site. The materials usually come from a shore where relatively high density consolidation of solids has occurred. At the disposal site, the dredged solid materials typically remain solid as they fall from the dumping transporting vessel to the marine bottom. Upon deposit under water on the marine bottom, these materials are completely unnatural to the marine bottom and still remain solid. The solid dredged materials pile up or mound. As a result, natural dispersal of the materials at the disposal site under the forces of estuine tidal and river current action does not readily occur. Soon the aquatic disposal site becomes plugged or filled with the discharged solid dredged materials. As a result, the aquatic disposal site is filled to an unnatural configuration with the resultant fill and another disposal site must be found—this new found disposal site eventually suffering the same fate.

Dredging methods of the prior art have an additional difficulty of failing to fully address pollution restriction requirements imposed upon current dredging operations. Typical pollution restrictions require that pollution "hot spots" be detected if present. Upon detection of any hot spots, treatment must be performed before any dredged materials containing unacceptable levels of the pollutants is returned to the marine environment. Hydraulic methods make detection of hot spots difficult because of the dilution of the solid in relatively large amounts of water. Failure to detect these pollutants subsequently causes them to be reintroduced without treatment, needlessly polluting the disposal site. Conventional clam shell dredging will permit the hot spots to be detected, but no convenient manner of treating the detected pollutants is available.

SUMMARY OF THE PRIOR ART

Slurry has long been used for the transport of comminuted solids. Such uses have typically been to facilitate transport through a pipe on dry land and have not been associated with dredging of solid materials. Slurries used for transport by pumping typically differ from the slurries used herein. Typically, such slurries when transported by pumping at a constant elevation having densities 1.5 times that of water or less. Such slurries are essentially "non Newtonian fluids" and are dependent upon shear stresses, slope (usually downhill), and numerous other factors to maintain flow.

Typically, such slurries are not stabilized or semipermanent slurries. Moreover, they are pumped in a pipe with turbulent flow. This turbulent flow maintains the suspension of the transported particles.

In such a process, the solid materials are comminuted or pulverized into a fine powder. Thereafter, sufficient water is introduced to produce a slurry. The resultant slurry is thereafter transported—typically by pumping through a pipe—to a disposal site. At the disposal site, the slurry is dumped. Usually, the slurry is received into an isolated volume where it is dried, depositing the transported solids. Alternately, the slurry can be left as permanent waste—altering the environment of the disposal site more or less permanently. Solid materials transported in a slurry have included tailings of various kinds, coal, ores and the like.

Machines for the generation of slurries are also well known. Such machines have included a receiving hopper, a grate for the separation of large materials, water jets, and a receiving mixer—such as a pump—for creating and discharging the slurry. Examples of such apparatus can be found in U.S. Pat. No. 4,017,032 to Dyas and U.S. Pat. No. 1,818,967 to Allen.

None of the above patents suggests the use of slurry in conjunction with clam shell dredging. Further, and as distinguished from slurries used to transport entrained solids by essentially level pumping in turbulent flow, the slurries utilized here have a density of at least 1.8 times that of water. They are generally unsuitable for transport by pumping.

SUMMARY OF THE INVENTION

An apparatus and process for solid dredge material disposal is disclosed for changing the solid materials into a dense slurry for more advantageous dispersal at the aquatic disposal site. The apparatus is a hopper discharging to a large high volume, low head marine pump supplied with water and power by umbilical attachment to an excavating dredge. The hopper is preferably placed aboard a bottom dump barge for receiving and loading the processed dredge materials from a clam shell dredge to the barge.

The clam shell dredge excavates from under the surface of water solid dredge materials and discharges the materials onto the hopper placed on a barge. The hopper has a grate through which the dredged material falls to the suction of a high volume, low head pump. The high volume, low head pump is driven by a constant torque, variable speed drive to enable the pump to tolerate intermittent volumes of mud at the pump inlet without the danger of pump speed variation eventually damaging the pump.

The grate placed on top of the hopper effects initial screening of dredged debris as well as breakup of the solids into parcels which pass the preferred one foot maximum dimension for clearance of the grate. A matrix of water jets impacts the debris falling from the grate to the pump suction inlet for further break up of the material, the addition of the necessary fraction of water to create a slurry, and to assure the requisite lubricity of the entire mixture at the pump.

The dredged material then passes through the pump in intermittent batches creating a slurry. The slurry is then discharged to a barge, preferably an open bottom dump barge moved by tug from the site of the marine excavation to the disposal site. The slurry is self loading to the barge constituting a liquid which is self leveling within the barge. By initially creating a high density slurry for deposit into the barge, concentration of the dredged material is not necessary at the dredge site. This eliminates the presence of a silt plume at the dredging site making the site cleaner and significantly reducing the environmental impact of the dredging operation.

At the discharge site, the dredged material slurry falls rapidly to the bottom with minimum silt plume confining silt damage in marine life to the immediate vicinity of the disposal site. At the same time there is deposited in the water of the disposal site the slurry which can thereafter be subjected to estuine dispersal by tidal and river currents in a natural manner to avoid filling of the disposal site.

The present apparatus and method significantly improves upon all aspects of any pollution detection and treatment required at a dredging site. First, the high density slurry has sufficient solid concentration to permit it to be tested easily for pollution contaminants as opposed to the prior art diluted dredge mixtures obtained with hydraulic dredging methods. Second, the creation of the slurry by the matrix of fluid jets provides an unequalled chance to treat any hot spots by metering necessary chemicals or substances into the fluid creating the slurry, thereby thoroughly treating the pollutants at the very instant that the slurry is created. Third, the slurry has an ability to disperse local hot spots throughout the entire barge, significantly reducing any contaminate levels. The hot spot may be environmentally unacceptable in its solid form, but upon being made into a slurry and dispersed within the barge, the contaminate concentration may be reduced to levels which become acceptable.

OTHER OBJECTS, FEATURES AND ADVANTAGES

An object of this invention is the disclosure of a dredging process which is suited for use with clam shell excavation. According to this aspect of the invention, solid dredged material having slump is removed by positive displacement excavating means—usually a clam shell bucket—from the marine bottom. This material is then made into a slurry by the introduction and mixture of even a greater quantity of water than the solid dredged materials had in their natural undisturbed state. The slurry created is preferably a high density liquid mass exceeding 1.8 times the density of water. This high density slurry is unable to support mounding or slump. This slurry is deposited immediately in a receiving barge and thereafter transported and dumped at a marine disposal site for dispersal by natural estuine tidal current and river current action.

It is to be noted that an unobvious step is believed to be present. Specifically, water is added to dredged materials. While a slurry is created, this slurry is generally unsuitable for transport by any kind of pumping because of its relative high density. What is meant as unsuitable for transport by pumping includes utilizing a pipe and single pump for the level transport of the suspended solid over a distance exceeding 1000 feet.

Therefore, a distinguishing feature of this invention over the dredging prior art is that the volume of materials required for transport to the disposal site is increased by the water content added. At the same time, a generally useless high density slurry mixture is created - having a solids content in the range of 60 percent. The transport of such high density slurry by pumping is not practicable.

An advantage of the disclosed process is that a dredged material slurry is created having an extremely high solids content. For example, the resultant slurry usually has a density exceeding 1.8 times that of water. Over the transport of clam shell excavated solids, the solids that would fill approximately four barge loads can be transported as the disclosed slurry here utilized in five equal barge loads. As a result, the cost of transport to the disposal site is not appreciably increased.

An additional advantage is that the loading of the transporting vessel is appreciably simplified. Specifically, and because a slurry is used, the transporting vessel is typically self leveling. The dredge operator (or leverman) is not required to dump the dredged materials on a barge with loading distributed to maintain even floatation of the barge.

A further advantage is that positive displacement dredging at the marine excavation site can be preserved. Specifically, a clam shell dredging bucket can be manipulated with precision to excavate the metes and bounds of the marine excavation site. At the same time, the plume of silt materials at the excavation site can be maintained at an absolute minimum. Marine life local to site of excavation remains unaffected to the maximum extent possible given the requirement for the dredging in the first instance.

Yet another advantage of this invention is the reduction of the resultant plume when the materials are dumped at the disposal site. Typically, and upon dumping, the dense slurry sinks rapidly to the bottom. Sinking is so rapid that even the propeller wash of the propelling transporting vessel or associated tug does not appreciably add to the resultant plume. There results an immediate and quick deposit of the dredged materials to the marine bottom of the disposal site.

At the same time, the deposited dredged material slurry at the marine disposal site are received to the marine bottom in a state not unlike the naturally occurring marine bottom environment. Since the materials are similar to the naturally occurring bottom, the dredged material slurry is subject to dispersal by natural estuine tidal and river currents. Much in the manner that the natural bottoms of such disposal sites are moved and dispersed by such currents, the deposited dredged material slurry is likewise moved and dispersed by such tidal forces. As a result, the topography of the marine disposal site is left substantially unaltered. The aquatic disposal site is not filled.

A further object of this invention is to disclose the adaptation of a high volume low head marine pump for the processing of bucket discharged solids into a slurry. According to this aspect of the invention, the traditional constant horse power drive utilized with a pump that sees constant suction is replaced. Replacement occurs with a constant torque, variable power drive. As a result, the pump becomes aptly suited for rendering the solid dredged materials to the slurry format. At the same time, the intermittent loading of the pump does not cause undue strain or overloading of the pump.

A further object of this invention is to control the density of the slurry discharge to a maximum possible density. According to this aspect of the invention, the dredged martials are deposited into a hopper having a grate. The grate catches debris unsuitable for passage through the pump and effects primary breaking up of the dredged solids. The material then falls to a hopper having a controlled number of operating jets. Water is introduced to the mixture at a rate sufficient to produce only a dense slurry having the maximum possible solids content. The introduced water assists in material breakup and maintains the required pump lubricity as the dredged material solids pass through the pump and becomes a slurry. There results a dredged material slurry which for the first time can have its density controlled by the dredging operator. This slurry has been found optimum for dispersal by natural forces at the disposal site.

Still another object of the present invention is to promote efficient, accurate, reliable and economical detection and treatment of pollution contaminants found at a dredge site. According to this aspect of the invention, the high density slurry permits detection of pollutant contaminants simply and ideally. Any contaminants may be directly treated during the slurry production steps by including treatment substances in the fluid used to break down the solid and convert it to a slurry. Concentration of the contaminants may be dispersed throughout the barge by natural diffusion principles, resulting in acceptable levels of pollutants. Detection and treatment of pollutant contaminants is thereby improved over conventional methods.

BRIEF DESCRIPTION OF THE DRAWINGS

Other objects, features and advantages of this invention will be more apparent after referring to the following specification and attached drawings in which:

Referring to FIG. 1, a clam shell dredge D is illustrated included a derrick 20, a boom 22, and attached clam shell bucket C. Clam shell bucket C serially excavates a typical cut here illustrated at S. Dredge material from the bucket is deposited at the hopper H on a receiving vessel V. Hopper H feeds to the suction inlet of a pump P and discharges to the receiving vessel V.

Figure 1:
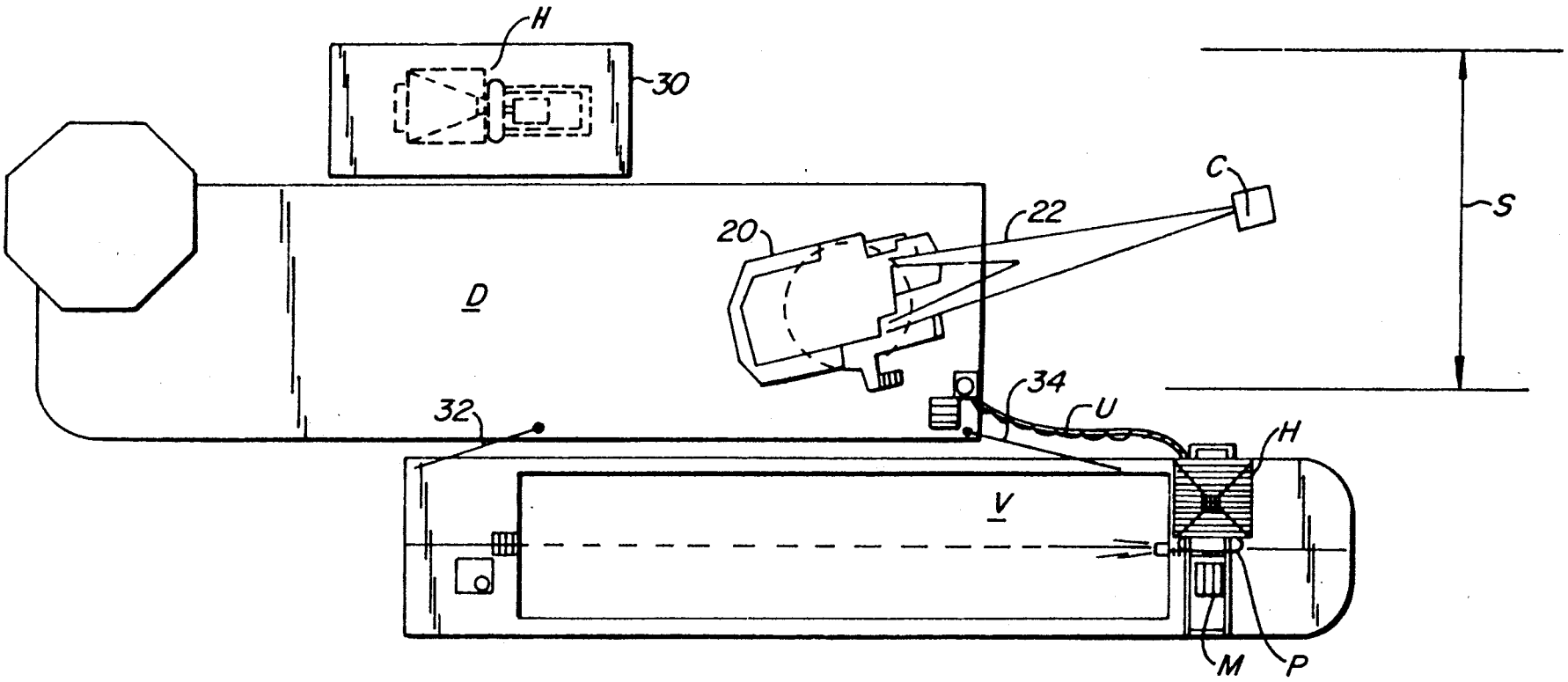
FIG. 1 is a plan view of a dredging operation illustrating a clam shell dredge having a dredged material transporting barge along side, this transporting barge being loaded with a hopper and connected pump for creating a dense slurry out of solids excavated by the dredge.
Figure 2:
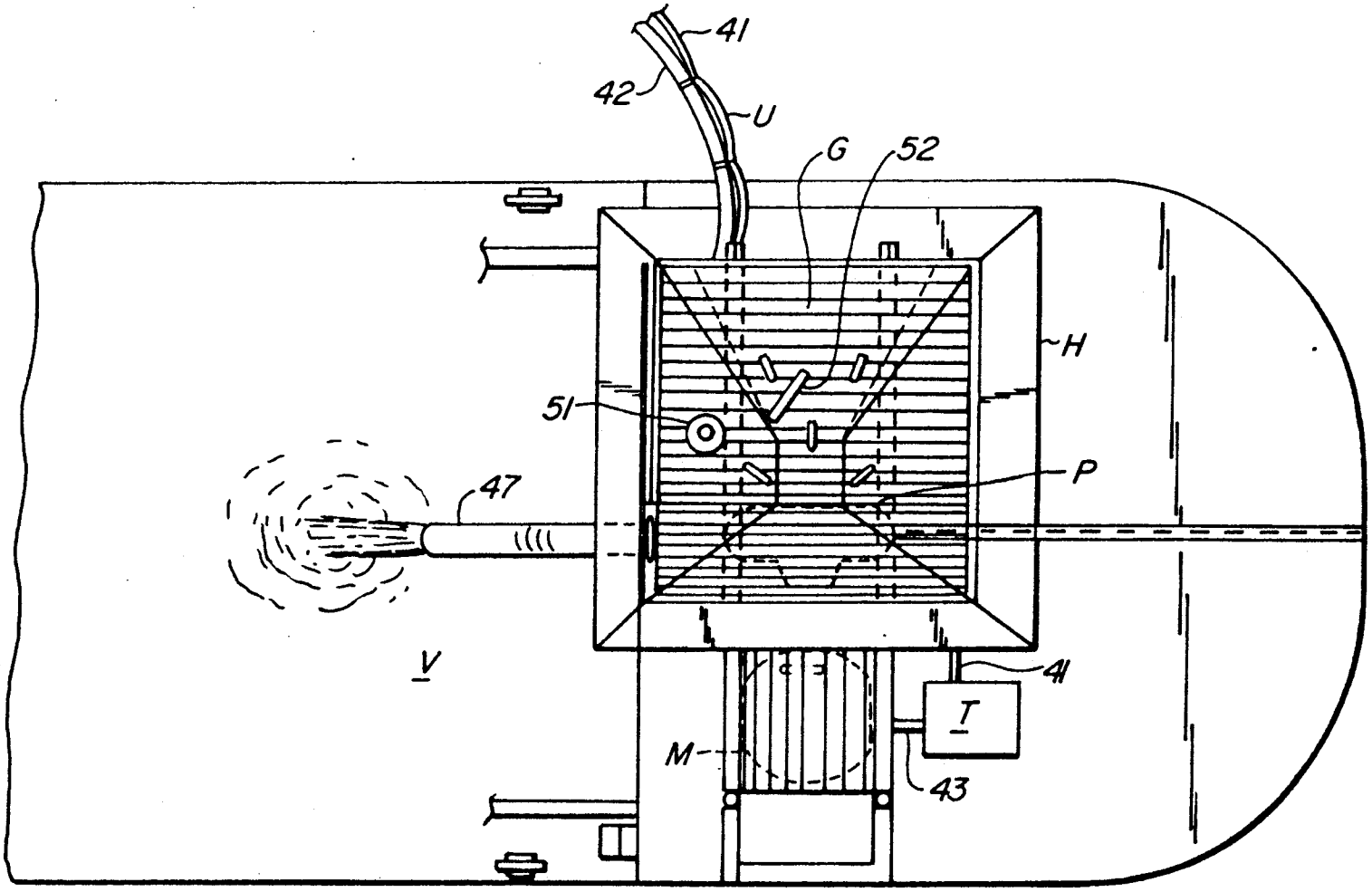
FIG. 2 is an elevation detail of a receiving barge for receiving excavated materials reduced to a slurry.

It can be seen that the hopper H is connected by an umbilical U powered from the dredge D. During loading of the vessel V, hopper H together with its pump P and motor M are temporarily loaded on the forward end of the receiving vessel V. Before the receiving vessel V is transported to a aquatic disposal site, the hopper H can be off-loaded to a supporting barge 30.

Normally, vessel V is secured to dredge D by lines 32, 34. As will be more apparent after referring to the following attendant description, maneuvering of the derrick 20 or the vessel V with respect to the dredge is not required as the slurry process herein disclosed effects a self-leveling loading of the transport vessel V.

Umbilical U is illustrated having a water conduit 42 and an electrical conduit 41. Electrical conduit 41 typically includes DC current supplied to a transmission T, which transmission T can be affixed either with the hopper or alternately be contained on the derrick barge.

Preferably transmission T effects a constant torque driving of the pump P through the motor M. This type of drive enables the impeller of the pump P to be intermittently loaded with high density mud which is generally unsuited for transport as by pumping.

It will be seen that grate G effects the catching of debris such as the tire 51 and the wooden pile 52. From time to time, this grate is removed and the debris deposited by the boom 22 of the derrick 20 on the assisting barge 30. In this way, debris is separated from the solid dredged materials to be processed.

Figure 3:
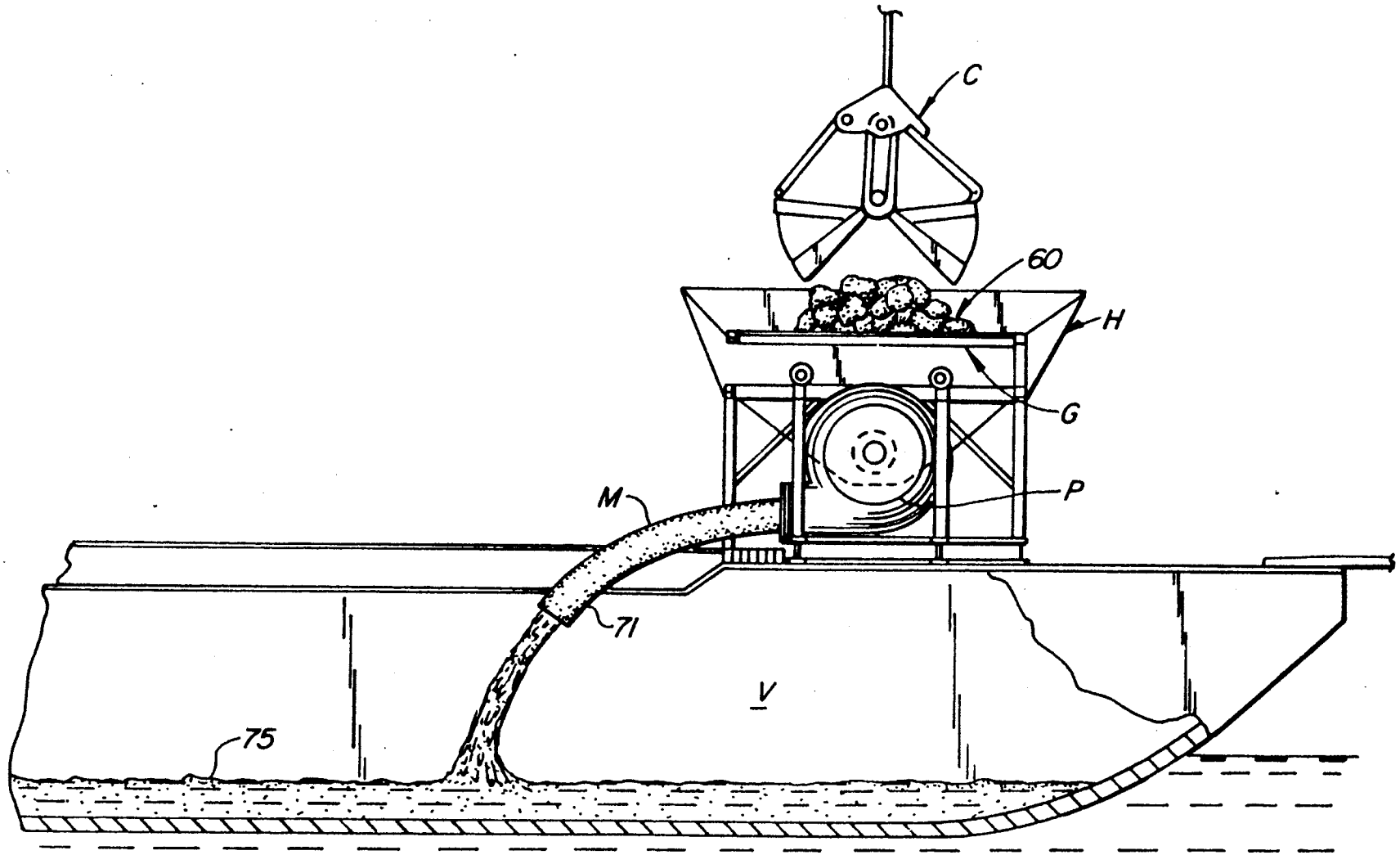
FIG. 3 is a side elevation of the barge of FIG. 2, this side elevation illustrating deposit into the bottom of the barge illustrated in FIG. 2 for bottom dump.

Referring to FIG. 3, the clam shell bucket C is shown depositing the solid dredge materials 60 into the hopper H at grate G. Hopper H extends a distance upwardly from the side of grate G to prevent the falling of the solid materials, especially into the interior of the vessel V.

A discharge 71 occurs to the bottom of the vessel V in a self-leveling slurry mass 75.

Figure 4A:
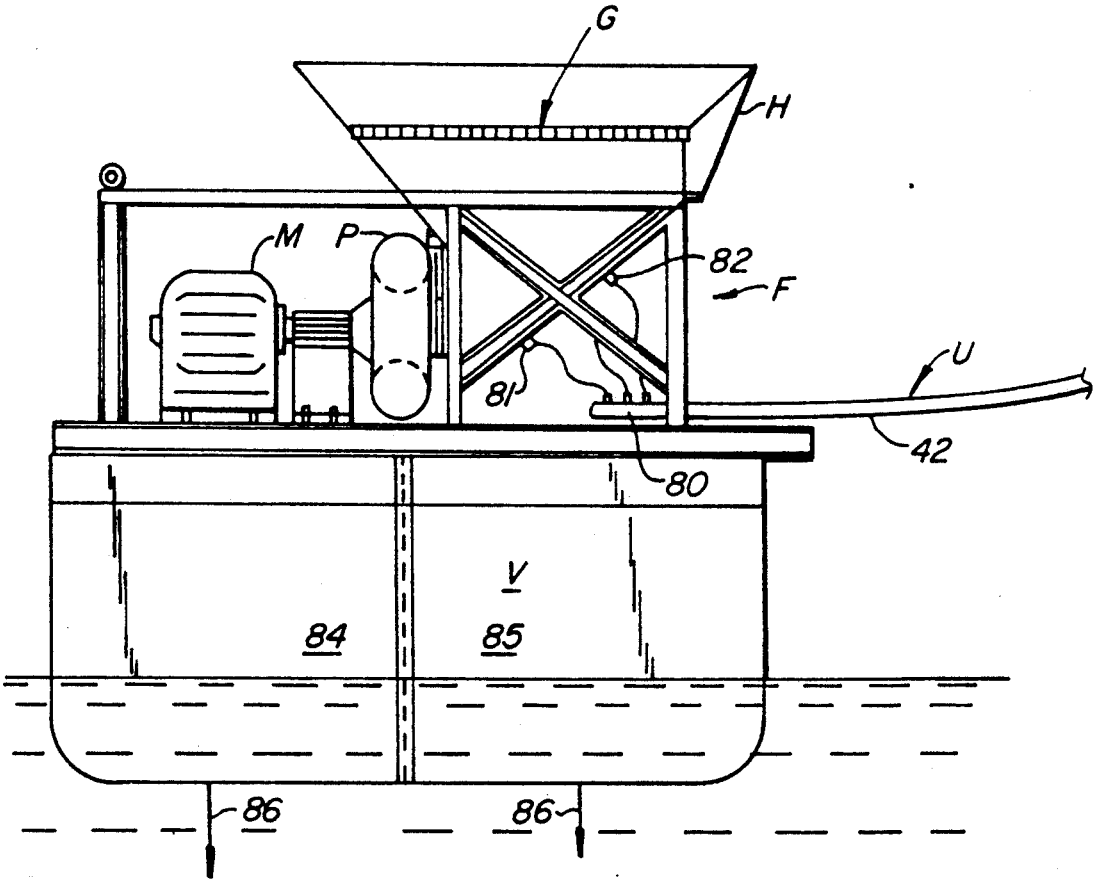
FIG. 4A is front elevation of a barge similar to that of FIG. 3 schematically illustrating the bottom dump split of the barge, the placement of the hopper on the barge as well as showing the hopper in section so that the grate may be seen.

Referring to FIG. 4A, a motor M and pump P are disclosed attached to a frame F having the hopper H and the grate G attached thereto. Umbilical U is illustrated at its hose 42 connecting to a manifold portion 80 which manifold portion 80 supplies discrete jets 81, 82 with water. Jets 81, 82 supply a measured amount of water to the incoming slurry for discharge on the bottom of the vessel V. As will be set forth hereafter, the number of jets used is varied; other jets may be activated to control the slurry density.

Typically, vessel V is a bottom dump barge. It includes first and second vessel segments 84, 85 which open overlying a aquatic disposal site and cause downward discharge of the contained dense slurry mixture as indicated at arrows 86.

Figure 4C:
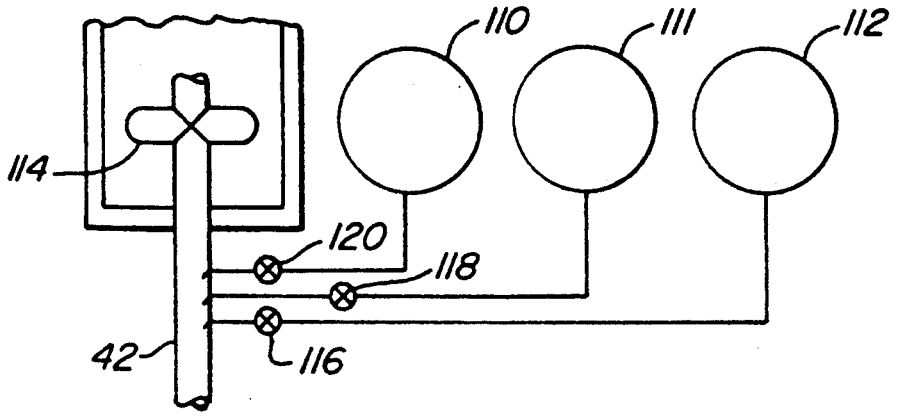
FIG. 4C is a detail of pumping including the introduction of chemicals to water supplied to the nozzles to treat the created dredge material slurry for the neutralization of pollution.
Figure 4B:
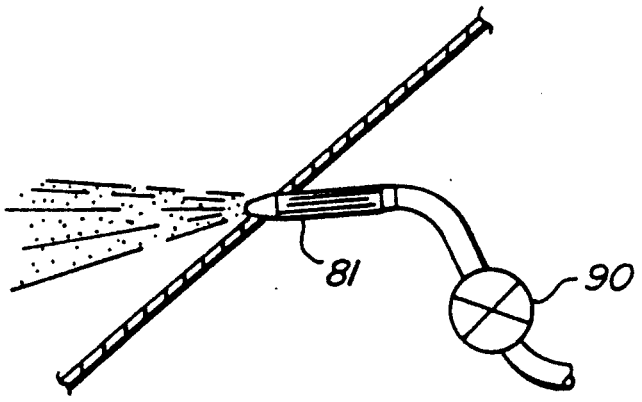
FIG. 4B is a detail of the hopper at one of the nozzles.

Referring to FIG. 4B, a typical nozzle 81 is illustrated. Nozzle 81 is a standard hydraulic nozzle having directional adjustments for pointing the nozzle discharge in any direction and a valve 90 for flow control.

Figure 5:
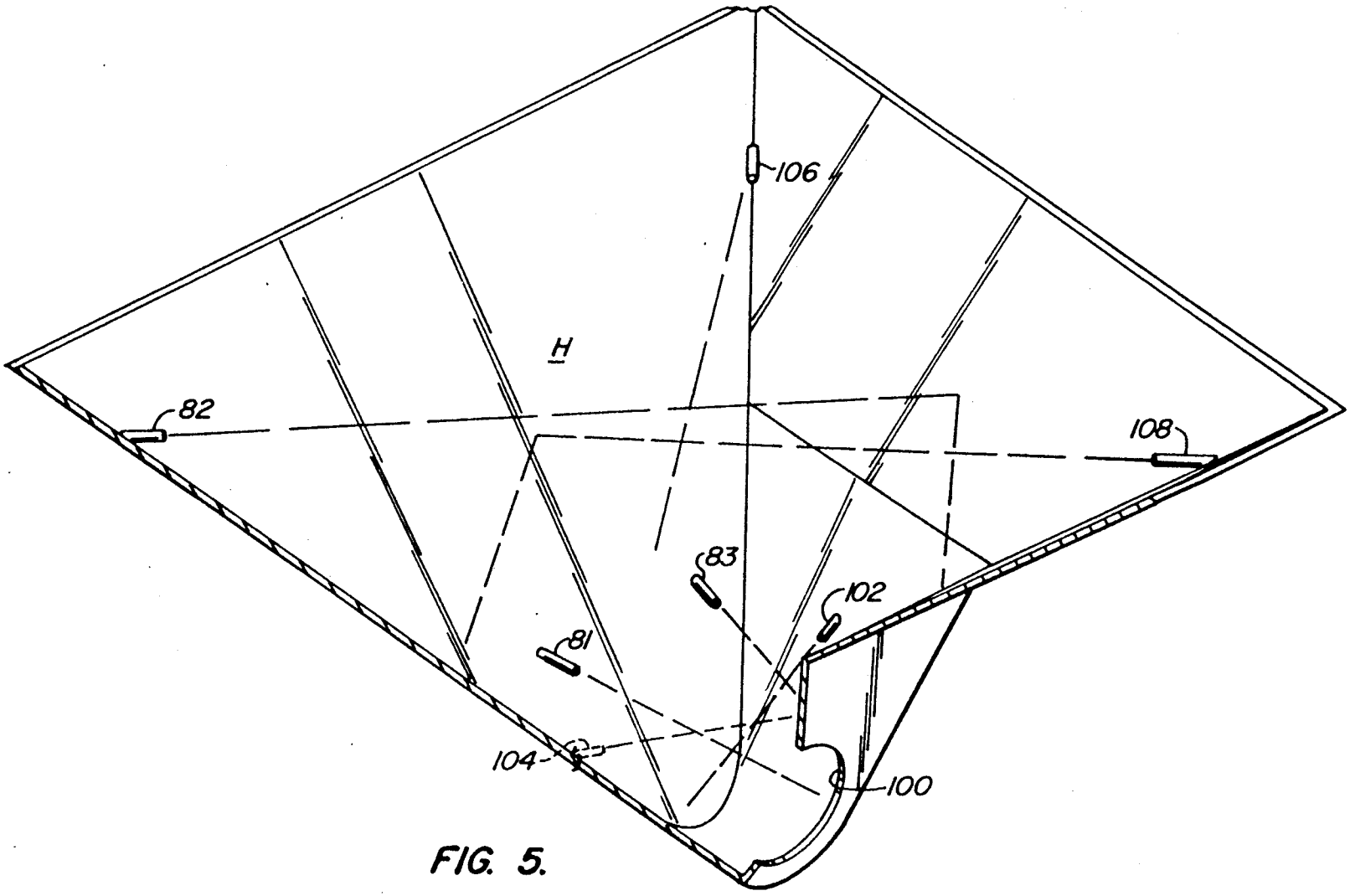
FIG. 5 is a perspective cut away detail of the processing hopper below grate.

Referring to FIG. 5, a complement of seven nozzles are illustrated. The nozzles include nozzles 81 and 83 directed at the suction inlet 100. Two additional nozzles 102, 104 complete the nozzle array at the pump inlet 100. Nozzles 82, 106 and 108 at the upper portion of the illustrated portion of the hopper section complete the nozzle array.

The directed spray has three effective purposes. First, the high pressure nozzles assist in the breakup of the solid dredge material. This being the case, the nozzles are not directed one upon another. They are instead directed along overlying and underlying paths so that the falling debris sees the full momentum and energy of the water discharged from the nozzles.

Secondly, the nozzles are operated to preserve that degree of lubricity at the pump necessary to maintain safe operation of the pump, Additionally, a constant flow of water into the pump helps to clean mud from pump blades reducing pump stress and in providing efficiency.

Finally, the nozzles are open to have a flow rate so that a dense slurry is realized. Specifically, the slurry here is generally unsuitable for the transport of solids by pipe excepting for transport at extremely short distances such as manifold M to the tanks 44, 45. To control this density, the operators of the hopper H typically operate only those nozzles necessary to supply that quantity of moisture necessary to produce the resultant slurry.

As a consequence, when extremely moist solids are excavated only those nozzles immediately adjacent the pump inlet 100 such as nozzles 81, 83 are operated. As the dredged solids become more dense, additional nozzles such as nozzle 102, 104 are added. Finally, and for the most dense solids, additional nozzles such as 82, 106, and 108 add to the flow volume.

Jets can be hooked up to chemicals. It will be realized that the creation of a slurry by waters supplied from the nozzles through water line 42 offers an unparalleled opportunity for the injection of neutralizing chemicals. Accordingly, and with reference to FIG. 4C, line 42 is shown having chemicals injected from tanks 110, 111, and 112 by a jet pump 114. Typically, chemicals in metered quantities at metering valves 116, 118 and 120 cause neutralizing chemical inflow to the nozzles themselves.

It will be additionally appreciated that the very creation of the slurry and batching of the slurry to the vessel V effects additional opportunities for control or treatment of polluted materials. Specifically, the contents of the vessel V as dispersed can be constantly monitored to determine the total contaminants present. Further, it will be understood that the creation of the slurry enables small concentrations of pollutants to be distributed over a large accumulated mass of dredged materials. In the case of such an accumulation and dilution, what may have been encountered hot spots of concentrated pollutants can thereafter be dispersed throughout the entire contents of the vessel V to yield an extremely diluted and dispersed material. Because of this dispersion, it often occurs that encountered hot spots which would be unacceptable for deposit at the disposal site because of their high concentration are dispersed to lower concentrations which are acceptable and environmentally safe at the disposal site.

Having set forth completely the mechanics of the device, some attention can be given to the process and the resultant slurry. This will be done with respect to FIG. 3.

Referring to FIG. 3, it can be seen that the solid material 60 deposited by the clam shell C first fall through the grate G. These materials if deposited on the deck of the vessel V would have a tendency to mound. This mounding tendency on the deck can be described appropriately as "slump". Slump is a technical term used to describe the slope of the sides of a deposited pile of solids. It is important to note that the excavated materials have such a slope.

If these excavated materials were to be deposited into a marine environment and dumped under water and even greater slope of the mound or slump would be produced. Consequently, the materials would have a tendency to fill or otherwise mound the disposal site soon rendering it useless.

Typically the materials fall through the grate G are impacted by the underlying nozzle array and pass through the pump P.

As has previously been mentioned, pump P is driven by a constant torque drive. Thus, the pump P acts primarily as a slurry processor. It is not effectual for the transport of the materials by pipe for any effective distance. Indeed, utilizing a hopper dredge pump having a 24" discharge driven by a 500 horse power motor with a constant torque transmission, little pumping effect is observed. Instead, the created slurry rapidly falls to the bottom of the receiving vessel V. Substantially the full effort of the pump is required to create the slurry and effect discharge. Virtually no pump pressure or head is available for the pumping transport of the slurry through the pipe.

It has the been said that slurry is generally unsuitable for pumping. Typically, densities of the slurry exceed 1.8 times the density of water—and are more usually in the range of 2.0 times the density of water. There also exists other reasons as to why the disclosed slurry is unsuitable in the traditional sense for transport by pumping through a pipe.

The slurry here produced is more properly known as a "stabilized slurry." It does not rapidly come out of the suspension that is created. This is a property created by the mineral mud mix commonly found in most estuine conditions, especially the Sacramento River Delta in California, USA. Further, and unlike ordinary transport slurries, the slurry here will not typically move with the required turbulent flow found in slurry transport situations. As is well known in the slurry transport arts, the usual turbulent flow used in slurry transport is vital to maintain the transported particles in their required suspended state.

With the dense slurry here created, pumping transport of the material will rapidly deteriorate to the lamina flow (non turbulent flow) state. Such flows typically create extreme high back pressures consuming undue power requirements for pumping short distances. Accordingly, it is believed that the slurry here created does not have parallel with its mass transport counter part in the prior art.

Observation of the slurry at discharge 71 is instructive. The general consistency of the material is similar to bovine animal waste. Falling aggregates of the slurry appear not unlike liquified clots of dirt.

Upon impact at the bottom of the vessel V a liquid film otherwise covers a slurry surface having an uneven texture. However, the uneven textured surface is level. It does not mound. Furthermore, it flows in a leveling manner very slowly the entire length of the waiting vessel V. Such flow occurs and can be observed in a barge having a length on the order of 100 yards.

By way of example, a typical barge of the bottom dump variety utilized with this invention has a capacity of 3,000 cubic yards. Utilizing a pump with an impeller on the order of eight feet in diameter with a 24 inch discharge, a fifteen yard clam shell bucket C requires an interval of six hours to fill the vessel V.

The load on pump P is intermittent. Typically the pump P upon the deposit of a load 60 of solid dredged materials is under intense suction for periods of approximately 40 seconds. Thereafter, and until the next load arrives, only the water from the nozzles flows out the discharge 71.

The reader will appreciate that the volume of the discharge material 60 is relatively great when compared to the discharge of the discrete nozzles. Therefore, and during intervals when material 60 has been cleared from the hopper H, the ambient water flow does not appreciably change the density of the slurry 75 although a minor mixture may occur.

Referring to FIG. 3, and when bottom dumping occurs as indicated at arrows 86, a further advantage of this invention is realized. Specifically, the created slurry being almost twice as dense as water immediately falls to the bottom of the marine environment. Such falling occurs without a noticeable plume being visible on the surface of the water.

It will be noted that during such dumping operations it is common to propel barge B at a propulsion system using propellers such as that attached to an attending tug. This propulsion and the propeller wash therefrom has not been a source of further aggravation of the resultant dump silt plume. Utilizing the technique herein set forth, falling of the slurry is so rapid that disturbance of the plume by the propeller wash of the propelling vessel does not occur.

It has additionally been found that the addition of a slurry as distinguished from the addition of a solid to the marine disposal site is advantageous. Specifically, the resultant slurry when deposited can be dispersed by normal bottom currents such as estuine tidal and river current action. Specifically, the added slurry material closely emulates that of natural marine bottom accumulation. Consequently, the treated dredged materials are deposited in a state where natural dispersal compatible with the environment occurs.

In conclusion the present invention offers advantages over conventional dredging processes in treating dredged materials for disposal. While the above is a complete description of the preferred embodiment, various alternatives, modifications and equivalents may be used. For example, an open barge has been illustrated. As will be readily appreciated, if extended chemical treatment of the high density slurry is desired, the slurry may be deposited into a tank and neutralized in a well-known fashion. Therefore, the above description should not be taken as limiting the scope of the invention which is defined by the appended claims.

What is claimed is:

1. A process for treating solid dredged material, comprising the steps of:

digging from a marine bottom at a dredging site through water solid materials by a positive displacement digging device; said solid materials capable of supporting mounding;

raising said solid materials from said marine bottom at said dredging site through said water to a processing location above the surface of said water so that said solid materials remain capable of supporting mounding during said raising step;

introducing water to said solid materials at said processing location above the surface of said water;

mixing said water and said solid materials at said processing location to produce a dense stabilized slurry having the maximum solids content and no longer capable of supporting mounding, said mixing occurring without discharge of silt containing water to said water adjacent said dredging site;

depositing, holding and transporting said stabilized slurry in a receiving vessel to an aquatic disposal site; and depositing said held stabilized slurry from said receiving vessel to said aquatic disposal site so that settling to the bottom of said stabilized slurry at said aquatic disposal site occurs with a minimum of silt plume and slurry dispersal occurs at said disposal site without mounding.

2. The treating process of claim 1 wherein said high density stabilized slurry has a density of at least about 1.8 times that of water.

3. The treating process of claim 1 including the steps of providing a hopper for receipt of said solid material and positioning means for mixing and expelling high density stabilized slurry at an outlet of said hopper, depositing said solid material into said hopper.

4. The treating process of claim 3 and including the step of providing said hopper with a grate; passing such solid material through said grate;

retaining debris on said grate.

5. The treating process of claim 3 wherein said providing a hopper step further comprises the steps of:

directing a plurality of fluid streams onto said solid material.

6. The treating process of claim 3 wherein said solid material includes a contaminant, said treating process further comprising the step of:

treating said solid material with substances introduced into said hopper during said mixing up.

7. The treating process of claim 3 wherein said high density stabilized slurry has a density of at least about 1.8 times that of water.

8. The treating process of claim 3 wherein said solid material is excavated by a clam-shell type bucket.

9. A process for dredging, comprising the steps of:

digging from a marine bottom at a dredging site through water solid materials by positive displacement digging; said solid materials capable of supporting mounding;

raising said solid materials from said marine bottom through said water to a processing location above the surface of said water so that said materials remain capable of supporting mounding during said raising step;

introducing water to said solid materials at said processing location above the surface of the water;

mixing said introduced water and solid materials at said processing location to form a stabilized slurry to produce a dense slurry unable to support mounding, said dense slurry unsuitable for transport by pumping, said mixing occurring without discharge of silt containing water to water adjacent said dredging site;

depositing said stabilized slurry in a receiving vessel at a single deposit point with respect to said receiving vessel;

permitting said stabilized slurry to self level in said receiving vessel; and transporting said stabilized slurry in and dumping said deposited and self leveled stabilized slurry from said receiving vessel at an aquatic disposal site so that settling to the bottom of said stabilized slurry at said aquatic disposal site occurs with a minimum silt plume and slurry dispersal occurs without mounding at said aquatic disposal site.

10. The dredging process of claim 9 wherein said high density stabilized slurry has a density of at least about 1.8 times that of water.

11. The dredging process of claim 9 and including the steps of:

providing a hopper for receipt of said solid material;

disposing means for mixing and expelling a high density stabilized slurry at an outlet of said hopper;

depositing said solid material.

12. The dredging process of claim 11 and including the steps of:

providing a grate for passing solid material and retaining debris;

depositing said solid materials through said grate to said hopper to remove debris from said solid material.

13. The dredging process of claim 11 and including the step of:

directing a plurality of fluid streams onto said solid material.

14. The dredging process of claim 11 wherein said solid material includes a contaminant, said dredging process further comprising the step of:

treating said solid material with substances introduced into said hopper during said liquefying step.

15. The dredging process of claim 11 and including the step of excavating utilizing a clam-shell type bucket.

16. A process for treating excavated solid dredged materials, comprising the steps of:

providing an apparatus for producing a high density stabilized slurry, said producing apparatus including a hopper having an inlet and an outlet, and means for mixing and expelling coupled to said hopper outlet;

depositing excavated solid material into said hopper, said excavated solid material capable of supporting moundings;

producing a slurry having maximum solid content by:

directing a plurality of streams of fluid onto said solid material to break up said materials: and operating said mixing and expelling means to produce a vacuum at said hopper outlet which extracts said broke up solid material from said hopper outlet, mixes fluid from said plurality of fluid streams and expels a high density stabilized slurry having the maximum possible solids content, said slurry unable to supporting mounding;

directing said expelled high density slurry to a receiving vessel at a dumping point on said vessel; and permitting said slurry to self level with respect to said vessel;

depositing said high density slurry from said receiving vessel to an aquatic disposal site.

17. The treating process of claim 16 and including the step of driving said mixing and expelling means by a constant torque, variable speed motor.

18. In a dredging process having solid material excavated by positive displacement and stored on a receiving vessel until deposit at an aquatic disposal site, the improvement comprising the steps of:

providing a hopper having an inlet and an outlet;

providing means for mixing and expelling to the outlet of said hopper;

depositing solid material into the inlet of said hopper, said solid dredge material capable of supporting mounding;

mixing and expelling said solid material in said hopper to break up said solid dredged material to produce a high density stabilized slurry unsuitable for pumping;

expelling said stabilized slurry into the receiving vessel;

permitting said slurry to self level within said receiving vessel; and, depositing the stabilized slurry at the aquatic disposal site.

* * * * *